US005491920A

United States Patent [19]

McCullers

[11] Patent Number: 5,491,920

[45] Date of Patent: Feb. 20, 1996

[54] ADJUSTABLE FIREARM BRACE

[76] Inventor: Jeffrey L. McCullers, 1208 S. 58th St., Tampa, Fla. 33619

[21] Appl. No.: 306,129

[22] Filed: Sep. 14, 1994

[51] Int. Cl.[6] ..... F41A 35/00

[52] U.S. Cl. ..... 42/94

[58] Field of Search ..... 42/94; 89/37.04

[56] References Cited

U.S. PATENT DOCUMENTS

| | | | |
|---|---|---|---|
| D. 348,215 | 6/1994 | Melborn | D8/380 |
| 4,575,964 | 3/1986 | Griffin | 42/94 |
| 4,844,390 | 7/1989 | Duke | 42/94 |
| 4,854,066 | 8/1989 | Canterbury, Sr. | 42/94 |
| 4,893,427 | 1/1990 | Davidson | 42/94 |
| 4,913,391 | 4/1990 | Klipp | 248/214 |
| 5,018,294 | 5/1991 | McGuffee | 42/94 |
| 5,194,678 | 3/1993 | Kramer | 42/94 |
| 5,345,706 | 9/1994 | Brown | 42/94 |
| 5,351,867 | 10/1994 | Vest | 42/94 |
| 5,402,595 | 4/1995 | Tamllos | 42/94 |

*Primary Examiner*—Charles T. Jordan
*Assistant Examiner*—Theresa M. Wesson
*Attorney, Agent, or Firm*—Pettis & McDonald

[57] ABSTRACT

An adjustable firearm brace for supporting the first end of a firearm. The brace includes a base that has an attaching means for attaching the base to a generally vertical support, an arm having a first end that is pivotally connected to the base for generally horizontal rotation of the second end of the arm about the base, and structure for supporting the muzzle end of a firearm being attached to the second end of the arm.

13 Claims, 4 Drawing Sheets

ADJUSTABLE FIREARM BRACE

BACKGROUND OF THE INVENTION

1. Field of the Invention

This invention relates to firearm supports and more particularly to an adjustable brace for firearms used for hunting or target shooting and is particularly adapted for use in a tree mounted hunting stand or a hunter's blind and the like.

2. Description of the Prior Art

It is well known that movement of a firearm just prior to and during its discharge usually results in a missed target, or at best, poor results. In order to fire accurately a hunter or a target shooter must be able to hold his firearm very still, particularly when firing at long range targets where only slight movement of the firearm results in great inaccuracy. Holding a firearm with out secondary or exterior support is difficult, particularly when hunters must remain prepared to fire over a long period of time, frequently at a target that remains in view for only a short period of time. The prior art discloses a number of devices that are designed to aid the hunter in maintaining his firearm at the ready and assists him in keeping the firearm steady while aiming at a target.

U.S. Pat. No. 4,844,390, issued to Henry Duke and U.S. Pat. No. 5,018,294, issued to Dennis McGuffee, both disclose devices that are attached to the hunter's body to provide support to one body part by bracing it against another body part. For example, the patent issued to Duke discloses an arm rest that is attachable to a belt around the hunter's waist and extends outwardly to engage the hunter's upper arm to provide support to the upper arm while the hunter holds a firearm. This device is particularly devised for the hunter as he moves through the woods searching for game. The McGuffee device provides support between the hunter's left elbow and his left knee and is particularly designed for a stationary seated position. Both the Duke and McGuffee devices are supported by the hunter's body, which does not provide the firm support necessary for accurate shooting.

U.S. Pat. No. 4,854,066 issued to Randall Canterbury, Sr., and U.S. Pat. No. Des. 348,215 issued to Terry Melhorn, both disclose firearm supports that are attached to stationary objects, the ground in the first case and a tree in the second case. The Melhorn device is a rod with screw threads at one end for screwing into a tree and a Y-shaped rest at the other end for supporting the firearm. The Canterbury rest supports the firearm in two positions, the forward portion of the stock usually gripped by the left hand of a right handed shooter and the area adjacent the trigger gripped by the right hand of the shooter. The firearm rotates about the left hand position providing the hunter with a limited field of fire if the body of the hunter is to remain relatively still, as even though the firearm may be rotated 360° the hunter must scramble to new positions as the firearm rotates making it difficult to fire on moving game. The Canterbury support is primarily designed for firing upon fixed targets or targets with little range of movement.

U.S. Pat. No. 4,913,391 issued to Kenneth Klipp, discloses a clamp with a rotatable V support upon which to rest the firearm. The device is attached to a fixed structural member such as a stand or hunter's blind. Again, the butt of the firearm rotates about the axis of the support requiring the hunter to constantly shift his position as the firearm is rotated about the axis of the support. Excessive movement by the hunter reduces the effectiveness of the support when used to cover wide fields of fire.

Therefore it remains clear that there is a need for a support that may be fixed to a firm structure to provide solid support and yet allows the hunter to remain in basically the same position while the muzzle of a firearm is pivoted over 180°.

SUMMARY OF THE INVENTION

The current invention relates to an adjustable firearm brace that is particularly adapted for use in a hunter's stand attached to a tree or to a hunter's blind. The adjustable firearm brace is attached to the tree supporting the tree stand or to a support attached to the hunter's blind. This brace may also be used by a person seated in a chair that has a support to which the device may be attached, or the brace 10 may be attached to any structure capable of supporting it. A support driven into the ground or supported by other structures may also be used. The adjustable brace comprises a base, an attaching means for attaching the base to a support, an arm, and a means for supporting a firearm. The first end of the arm is pivotally connected to the base for generally horizontal rotation of the second end of the arm about the base. A means for supporting the first end of a firearm is connected to the second end of the arm and extends outwardly therefrom. The brace is attached to the support so that at least a portion of the arm lies above the hunter's head when the hunter is in a shooting position. The first end of the firearm is rested on the means for supporting the firearm. As the hunter moves his firearm to take aim at a target the arm moves with the firearm providing stability to the first end of the firearm.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
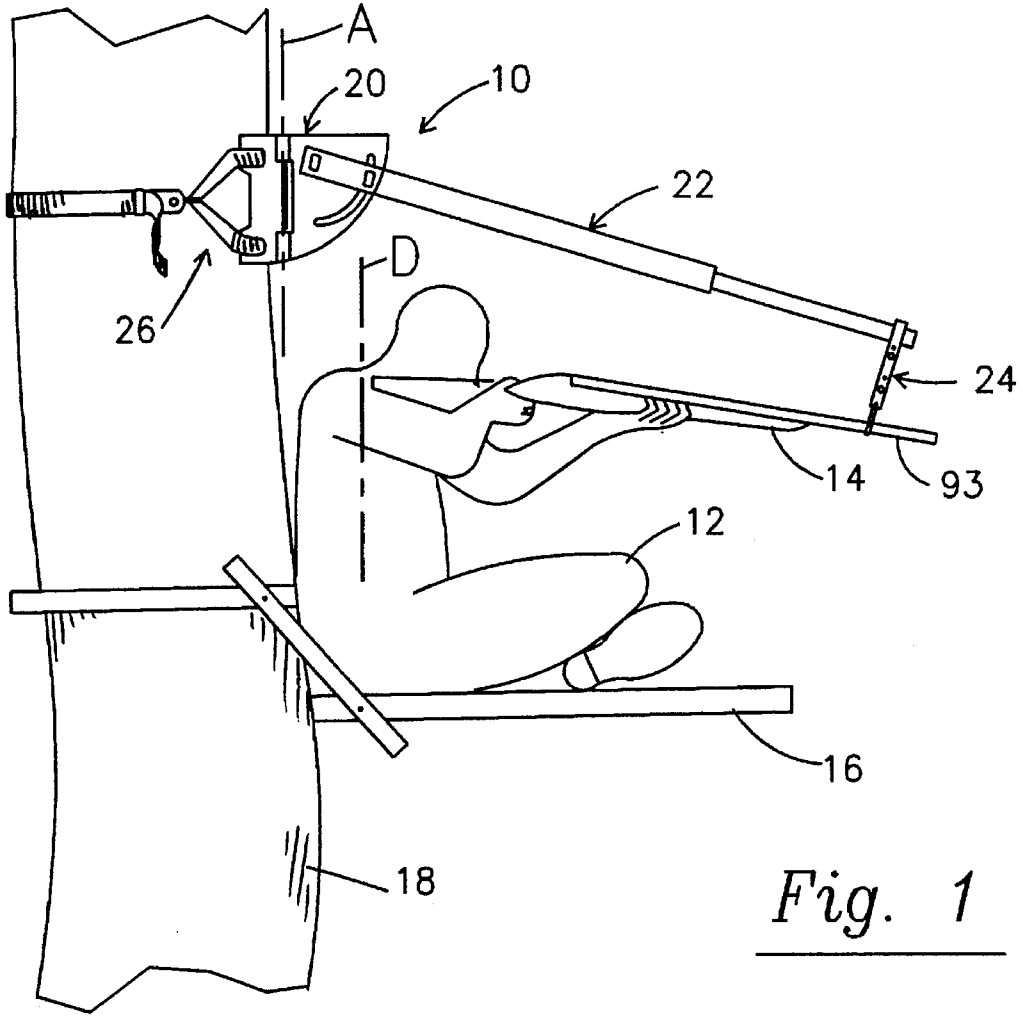
FIG. 1 is a front elevational view of the invention illustrating a hunter in a tree stand using the invention.

A preferred embodiment for the adjustable firearm brace of this invention is illustrated in the drawing FIGS. 1–4, in which the firearm brace is generally indicated as 10. In FIG. 1 the firearm brace 10 is illustrated as being used by a hunter 12 holding a firearm 14 while seated on a tree stand 16 that is attached to a tree 18.

Figure 2:
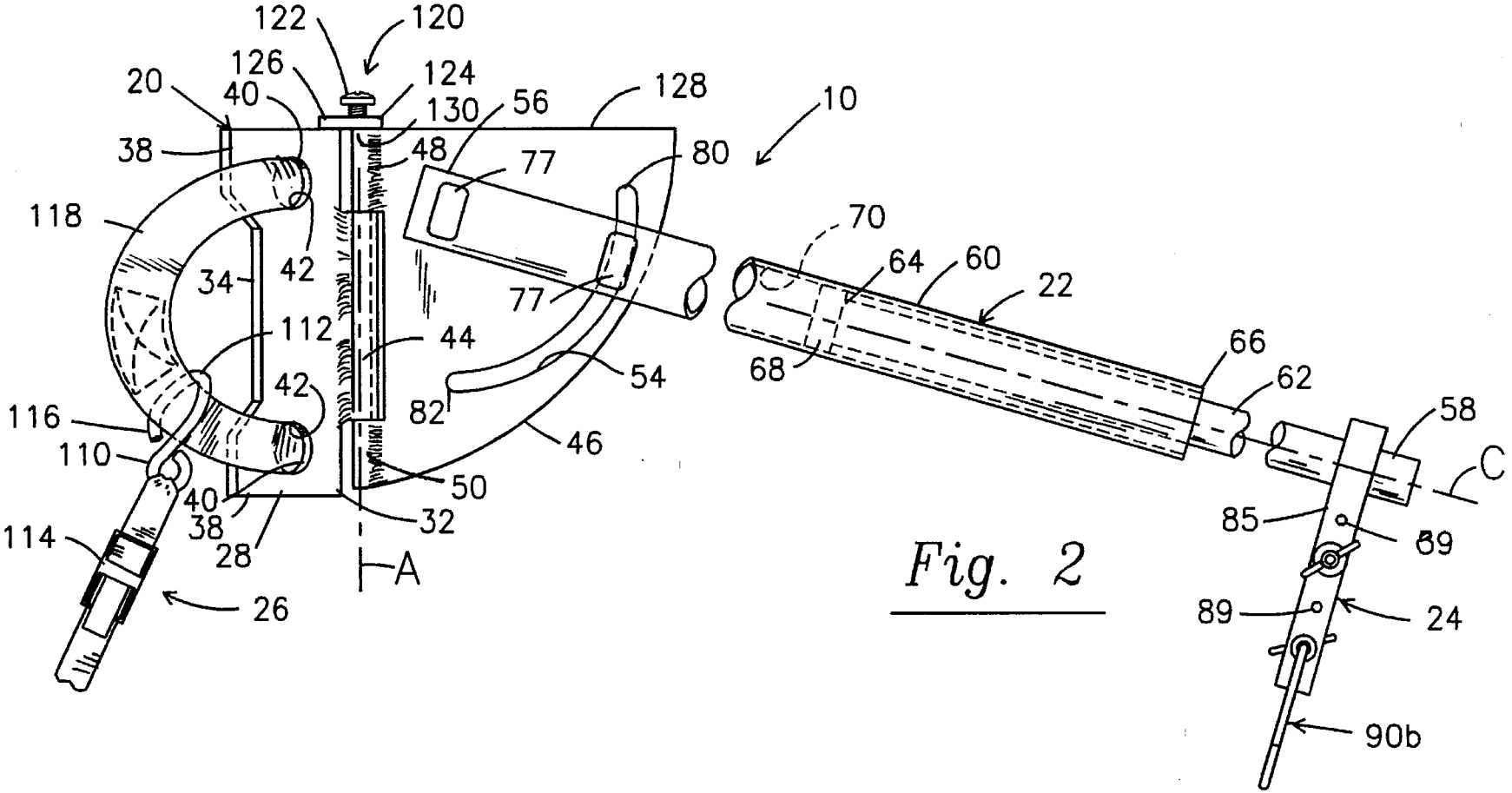
FIG. 2 is an enlarged front elevational view of the invention of FIG. 1 with portions of the arm broken away for convenience.

Referring first to the view of FIG. 2, it can be seen that the brace 10 comprises a base shown generally as 20, an arm shown generally as 22, a means for supporting a firearm shown generally as 24 and an attaching means shown generally as 26.

Figure 3:
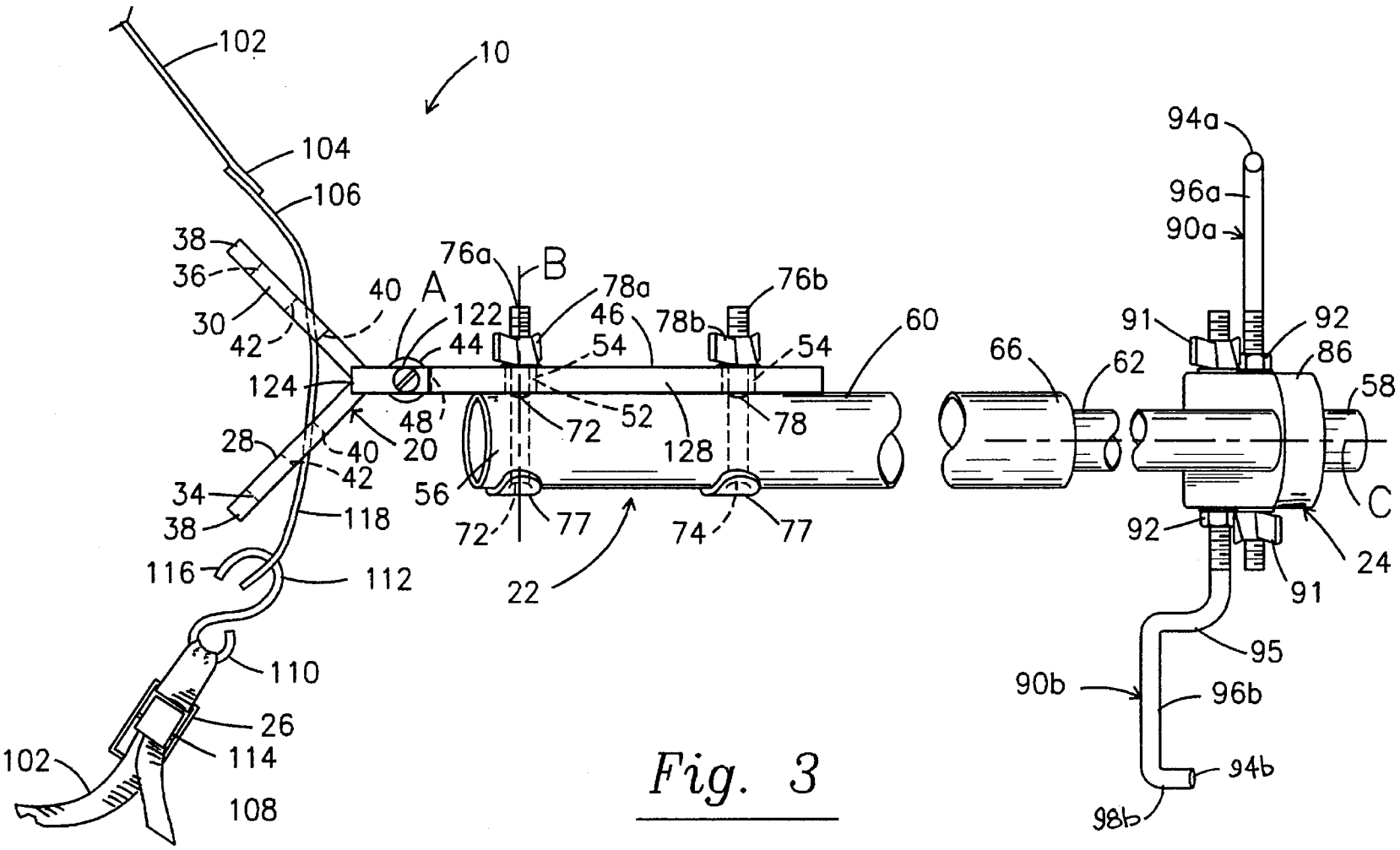
FIG. 3 is a top plan view of the invention of FIG. 2.

As best seen in FIGS. 2 and 3, the base 20 is comprised of a first plate 28 and a second plate 30 that are joined along one longitudinal edge of each plate 28 and 30 to form a joint 32. Edge 34 and edge 36 of plates 28 and 30 respectively, each oppose the joint 32. Edge 34 and edge 36 each have a pair of projections 38 that extend outwardly and generally in the same plane as the corresponding plates 28 and 30. In other embodiments, the projections may be angled inwardly toward the opposing plate 34 or 36 to provide a firmer grip of the support to which the base 20 is to be attached. Further, each plate 28 and 30 has a pair of holes 40 therethrough that lie proximal to the joint 32. In the embodiment disclosed in the FIGS. 1–4, the holes 40 are circular and the edges 42 where the holes 40 penetrate the plates 28 and 30 are rounded to reduce the wear on the portion of the attaching means 26, as more fully described hereinafter, that passes through the holes 40. A hinge means, conveniently hinge 44, is attached to and extends along the joint 32. In the embodiment disclosed in FIGS. 1–4, the hinge comprises a shaft and sleeve arrangement that is well known in the art.

A plane member 46, having a generally uniform thickness, has a first edge 48 that is attached to the shaft 50 of the hinge 44, by welding or other well known means. The member 46 is rotatable about the longitudinal axis A of the shaft 50 of the hinge 44. The member 46 has an aperture 52 and an arcuate slot 54 therethrough. The radius of the arcuate slot 54 extends from the center of aperture 52. The slot 54 subtends an angle of approximately 90°. The member 46 may rotate about axis A from the first plate 28 to the second plate 30.

The arm 22 has a first end 56 and a second end 58. The arm 22 further comprises a first part 60 that includes the first end 56 and a second part 62 that includes the second end 58. In the preferred embodiment disclosed in FIGS. 1–4, the arm 22 is formed from hollow tubing with the first part 60 having a diameter greater than the second part 62 so that, as seen in FIG. 2, the first end 64 of the second part is slidably received by the second end 66 of the first part 60. A cam 68 is attached to the first end 64 of the second part 62 of the arm 22, so that when rotated the cam 68 frictionally engages the interior wall 70 of the first part 60 preventing any further longitudinal movement of the second part 62 in relation to the first part 60. Such telescoping arms are well known in the art and any well known method for locking the two parts in relation to one another may be used satisfactorily in this invention.

The first end 56 of the arm 22 is rotatably attached to the member 46 for rotation of the second end 58 of the arm 22 about the first end 56 of the arm 22. The first end 56 of the arm 22 has a first arm hole 72 therethrough and a second arm hole 74 therethrough. A bolt **76*a* is passed through the first arm hole 72 and through the member hole 52. A butterfly nut 78*a* is attached to bolt 76*a* for easy attachment of the arm 22 to the member 46. The butterfly nut 78*a* is attached loosely to bolt 76*a* so that the arm 22 is free to rotate about axis B which is aligned with the axis of the bolt 76*a*. To lock the arm 22 in a selected position, a bolt 76*b* is passed through the second arm hole 74 and through the arcuate slot 54. A butterfly nut 78*b* is attached to the bolt 76*b*. As long as the butterfly nut 78*b* remains loosely attached to the bolt 76*b*, bolt 76*b* will slide along the arcuate slot 54 moving from a generally horizontal position at the first end 80 of the slot 54 to a generally vertical position at the second end 82 of the slot 54. When the butterfly nut 78*b* is tightened the arm 22 is held in a selected position. The heads 77 of the bolts 76 are curved to conform with the curvature of the arm 22 to prevent rotation of the bolts 76. In other embodiments, the first end 80 of slot 54 may extend upwardly so that the arm 22 may be rotated past the horizontal permitting the second end 58 of the arm 22 to extend upwardly. In the embodiment illustrated in FIGS. 1–4, the firearm brace is being used in a tree stand, therefore the rotation of the arm is from the generally horizontal to a downward position, as the firearm 14 will usually be aimed downwardly from the tree stand 16**.

Figure 4:
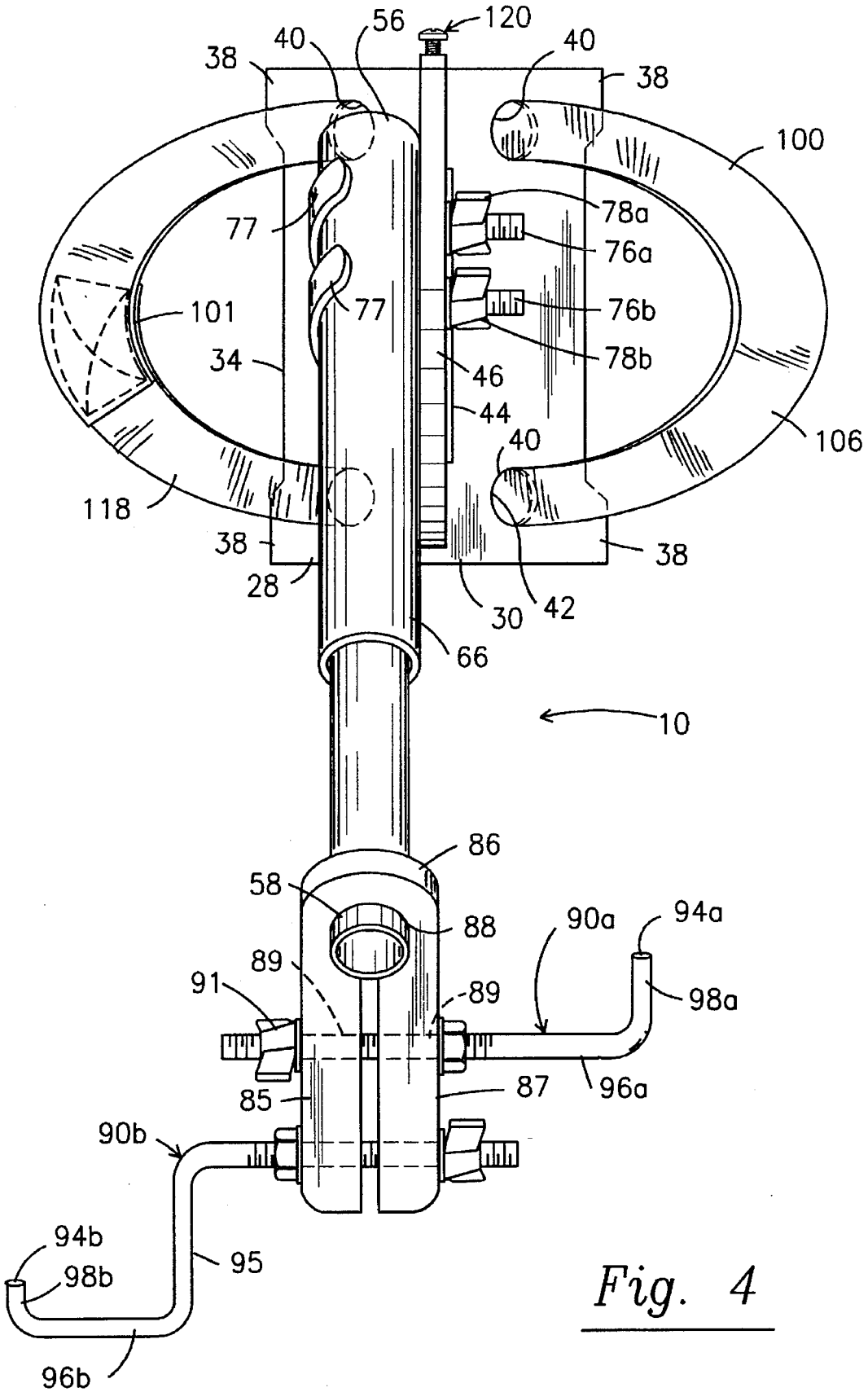
FIG. 4 is a right side elevational view of the invention of FIG. 2.

A means for supporting the first end of a firearm 24 is attached to the second end 58 of the arm 22. The means for supporting the first end of a firearm, conveniently leg 24, is removably connected to the second end 58 of the arm 22 and is attached generally normal to the longitudinal axis C of the arm 22. In a preferred embodiment disclosed in FIGS. 1–4, and as best seen in FIG. 4, the leg 24 comprises a U-shaped clamp 86 having a first segment 85 and a second segment 87. An enlarged opening 88 is formed intermediate the first segment 85 and the second segment 87. Opening 88 generally conforms to the cross sectional shape of the arm 22, in the illustrated embodiment the cross-section comprises a circle, so that it can receive the first end 58 of the arm 22 therein. The clamp 86 of the leg 24 has at least one hole 89 through each segment. The leg 24 further comprises at least one rod 90 that is received by the holes 89. Rod **90*a* is threadably attached by wing nut 91 and nut 92 to clamp 86 so that one end 94*a* of the rod extends outwardly from the clamp 86. By tightening the wing nut 91 the clamp 86 frictionally grips the first end 58 of the arm 22. Therefore, by loosening the wing nut 91 the clamp 86 may be rotated about the first end 58 of the arm 22 or removed. As seen in FIG. 4, the leg 24 extends downwardly from the arm 22. The rod 90*a* has a generally horizontal portion extending from clamp 86. Rod 90*a* also has a portion proximal end 94*a* that extends upwardly to provide an upward portion 98*a*. Leg 24 may comprise a second rod 90*b* attached to the clamp 86 in the same fashion as rod 90*a*. Rod 90*b* has a different configuration than rod 90*a* as a portion 95 of the rod, adjacent the segment 85, extends downwardly before extending generally horizontally. As seen in FIG. 4 the rods 90 may extend outwardly from either segment 85 and 87 to support left handed and right handed shooters. The first end 93 of the fire arm 14 is rested upon the horizontal portion 96*a* or 96*b*. In addition, the vertical portion 95 of the rod 90*b* may be of any convenient length so that the firearm is supported further below the arm 22. Also, additional legs in other embodiments may have different configurations, and one or more rods 90 may be simultaneously attached to the clamp 86**.

The attaching means 26 is used to attach the base 20 to a vertical support, which may be a tree 18 as shown in FIG. 1 or a manufactured post, chair back or other vertical supports of the like. In those cases, the base 20 may be attached or bolted directly to these prefabricated posts (not shown). There will also be occasions when the base 20 may be attached to a horizontal support. In a preferred embodiment illustrated in FIGS. 1–4, the base 20 is attached to a tree 18. The attaching means 26 comprises a strap 100 that is passed through each of the holes 40 with the ends 101 of the strap 100 attached to one another to form a loop 106 on one side of the base 20 and loop 118 on the other side of the base 20. The edges 42 of the holes 40 are rounded to reduce the wear on the strap 100. As seen in FIG. 3, a second strap 102 has a first end 104 that is attached to the first loop 106 by any conventional means, including sewing. The second end 108 of the strap 102 is passed through the eye 110 of a hook 112 and is then passed through a ratchet tie down 114. The open end of the hook 116 engages the second loop 118 of strap 100.

A stop means 120 is comprised of a set screw 122 and an element 124 having a threaded hole 126 therethrough. The element 124 is attached to the top edge 128 of the base 20 so that the set screw 122 when threadably engaging and extending through the threaded hole 126 engages the end 130 of the shaft 50 of the hinge 44. Fully tightening the set screw 122 prevents rotation of the shaft 50 and thus prevents rotation of the arm 22 about the base 20. Partial tightening of the set screw 122 provide frictional resistance to rotation reducing the rate of speed with which the arm 22 rotates.

In a preferred embodiment, the adjustable brace 10 is constructed from aluminum to reduce the weight that the hunter 12 must carry. The rods 90 are coated with a soft plastic to prevent damage to the bluing of the firearm 14. The strapping 100 and 102 is made from nylon for strength and wearability. Other well known materials may be used to make the brace 10 with satisfactory results, including but not limited to synthetic resins and steel.

Having thus set forth a preferred construction for the adjustable firearm brace 10 of this invention, it is to be remembered that this is but a preferred embodiment. Attention is now invited to a description of the use of the firearm brace 10. The description of use will be directed toward the use of the firearm brace 10 with a tree stand 16 as shown in FIG. 1, though as mentioned previously, the firearm brace 10 may be used with any structure capable of supporting the brace 10 above the ground.

After the tree stand 16 is in place, the hunter takes the position he plans to use in the tree stand 16 when firing the firearm 14 to determine the proper location for mounting the brace 10. The most popular position for the hunter 12 is a seated position with the hunter's back braced against the tree 18, as shown in FIG. 1. The hunter 12 marks the tree at a point over his head that will provide clearance for the arm 22 to freely swing overhead when the arm 22 is adjusted in the furthest desired downward position of the arm 22, the firing position for targets nearest the tree stand 16. The hunter 12 then centers the base 20 over the tree stand 16 insuring that the projections 38 solidly engage the tree 18 without wobbling. The second strap 102 with the rachet tie down 114 attached is passed around the trunk of the tree 18 and the hook 112 is attached to the second loop 118. The rachet tie down 114 is used to tighten the second strap 102 and base 20 to the tree 18.

The hunter 12 then takes his position and adjusts the brace 10 for optimal usage. By loosening the wingnut **78*b* the arm 22 may be lowered to the approximate position for the proper elevation of the first end 93 of the firearm 14 for firing at the target area. The wingnut 78*b* is then re-tightened to lock the arm 22 in the selected position. The second part 62 of the arm 22 is rotated to loosen the cam 68 so that the second part 62 may be extended to the position necessary for supporting the second end 93 of the firearm 14 on the horizontal portion 96 of rod 90*a* or 90*b*. The second part 62 is then rotated in the reverse direction to lock the cam 68 against the interior wall 70 of the arm 22. Fine adjustments may be made in the height of the second end 58 of the arm 22 and in the length of the arm 22**.

The hunter 12 may now place the first end 93 of the firearm 14 on the horizontal portion **96*a* of the rod 90*a*, thus resting the firearm 14 against a firm support so that the firearm 14 can be easily held with little movement. As the target comes into view the hunter 12 swings the firearm 14 to the left or right engaging the upward portion 98*a* or the second segment 87 respectively so that the arm 22 moves with the firearm 14 providing continuous support. If desired the hunter 12 can engage the stop 120 by screwing the set screw 122 downwardly until the set screw 122 engages the first end 130 of the shaft 50 of the hinge 44. Engagement of the set screw 122 with the shaft 50 prevents the arm 22 from rotating, allowing the hunter 12** to select a specific target and fix a very stable support.

Adjustments in the elevation of firearm 14 can be made by the hunter 12 by raising or lowering his body. Also elevational adjustment may be made by using the other rod **90*b* which is lower than 90*a*. The hunter 12 can swing the firearm 14 over 200 degrees with little change in the posture of the hunter 12. This is achieved as at least a portion of the arm 22 extends over the head of the hunter 12 and the axis A of rotation of the arm 22 about the hinge 44 is spaced apart from the first end 56 of the arm 22 and axis A is behind and generally close to the axis of rotation of the body of the hunter 12 when the hunter 12** moves to fire on a target.

It will thus be seen that the objects set forth above, among those made apparent from the preceding description, are efficiently attained, and since certain changes may be made in carrying out the above method without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language may be said to fall there between.

Now that the invention has been described,

What is claimed is:

1. An adjustable brace for a firearm having a first and a second end, said brace comprising:

a base comprising a hinge means having a generally vertical axis of rotation;

an arm, having a first end connected to said hinge means and a second end extending outwardly therefrom, said arm being rotatable about and spaced apart from said axis of rotation of said hinge means;

a means for supporting the first end of a firearm being connected to said second end of said arm and extending outwardly therefrom; and an attaching means attached to said base, said attaching means for mounting said base to a support.

2. A brace as in claim 1 further comprising; means for rotation of said second end of said arm about said first end of said arm, said means for rotation being attached to said first end of said arm and said means for rotation being connected to said base.

3. A brace as in claim 2 wherein said second end of said arm rotates about said first end of said arm in a generally vertical plane.

4. A brace as in claim 1 wherein said base comprises a member attached to said hinge means such that said member extends outwardly from said hinge means for generally horizontal rotation about said base.

5. A brace as in claim 4 wherein said first end of said arm is rotatably attached to said member for rotation of said second end of said arm about said first end of said arm.

6. A brace as in claim 1 wherein said arm further comprises a first part and a second part, said second part being slidably attached to said first part such that said second part longitudinally slidably extends therefrom.

7. A brace as in claim 1 wherein said base further comprises two plates joined at an angle to one another, each plate having an edge opposed to said joint, said opposing edge of each plate having a pair of projections extending therefrom and each plate having a pair of holes therethrough proximal said joint, said attaching means being attached to said holes.

8. A brace as in claim 1 further comprising a locking means connected to said base, said locking means being adjustable between an unlocked position wherein said second end of said arm rotates about said first end of said arm and a locked position wherein said second end of said arm is prevented from rotating about said first end of said arm.

9. A brace as in claim 1 further comprising a stop means attached to said base, said stop means being adjustable between an open position, where said arm is rotatable about said base, a partially closed position where rotation is resisted, and a closed position, where rotation of said arm about said base is prevented.

10. A brace as in claim 1 wherein said arm has a longitudinal axis and said means for supporting the first end of a firearm comprises: a leg attached to said second end of said arm, said leg being generally normal to said longitudinal axis of said arm, and extending outwardly from said arm, for engaging the first end of a firearm rested on said leg for support.

11. A brace as in claim 10 wherein said leg comprises a rod having a first end, said rod having a first portion that extends generally downwardly, said first portion being proximal said first end of said rod, and a second portion attached to said first portion that extends generally at a right angle to said first portion.

12. An adjustable brace for a firearm having a first and a second end, said brace comprising:

a base comprising a hinge means;

an arm, having a first end connected to said base and a second end extending outwardly therefrom, said arm being rotatable about said hinge means;

means for rotation of said second end of said arm about said first end of said arm, said means for rotation being attached to said first end of said arm and said means for rotation being connected to said base;

a means for supporting the first end of a firearm being attached to said second end of said arm and extending generally downwardly therefrom; and an attaching means attached to said base, said attaching means for mounting said base to a support.

13. An adjustable brace for a firearm having a first and a second end, said brace comprising:

a base comprising a hinge means;

an arm, having a longitudinal axis, a first end connected to said base and a second end extending outwardly therefrom, said arm being rotatable about a portion of said base;

a means for supporting the first end of a firearm comprising a leg attached to said second end of said arm normal to said longitudinal axis of said arm and extending outwardly therefrom, said leg further comprising a rod having a first end attached to said leg, said rod having a first portion proximal to said first end of said rod, said first portion extending generally downwardly, and said rod comprising a second portion extending generally at a right angle to said first portion, whereby the first end of a firearm is rested on said leg for support; and an attaching means attached to said base, said attaching means for mounting said base to a support.

* * * * *